US010355416B1

(12) United States Patent
Pickel et al.

(10) Patent No.: US 10,355,416 B1
(45) Date of Patent: Jul. 16, 2019

(54) ELECTRICAL CONNECTOR WITH INSERTION LOSS CONTROL WINDOW IN A CONTACT MODULE

(71) Applicant: TE CONNECTIVITY CORPORATION, Berwyn, PA (US)

(72) Inventors: Justin Dennis Pickel, Hummelstown, PA (US); Arturo Pachon Munoz, Hummelstown, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/936,631

(22) Filed: Mar. 27, 2018

(51) Int. Cl.

| | |
|---|---|
| ***H01R 13/648*** | (2006.01) |
| ***H01R 13/6477*** | (2011.01) |
| ***H01R 13/405*** | (2006.01) |
| *H01R 12/72* | (2011.01) |
| *H01R 13/6586* | (2011.01) |
| *H01R 13/514* | (2006.01) |

(52) U.S. Cl.
CPC ..... *H01R 13/6477* (2013.01); *H01R 13/405* (2013.01); *H01R 12/72* (2013.01); *H01R 13/514* (2013.01); *H01R 13/6586* (2013.01)

(58) Field of Classification Search
None
See application file for complete search history.

(56) References Cited

U.S. PATENT DOCUMENTS

| | | | | |
|---|---|---|---|---|
| 7,771,233 | B2 | 8/2010 | Gailus | |
| 7,794,278 | B2 | 9/2010 | Cohen et al. | |
| 8,262,412 | B1 | 9/2012 | Minnick et al. | |
| 8,366,485 | B2 * | 2/2013 | Johnescu | H01R 13/514 439/607.07 |
| 8,398,431 | B1 * | 3/2013 | Whiteman, Jr. | H01R 13/6587 439/607.06 |
| 8,771,016 | B2 | 7/2014 | Atkinson et al. | |
| 8,998,642 | B2 | 4/2015 | Manter et al. | |
| 9,666,998 | B1 | 5/2017 | de Boer et al. | |
| 9,917,406 | B1 * | 3/2018 | Iwasaki | H01R 13/6587 |
| 10,186,811 | B1 * | 1/2019 | Trout | H01R 13/6588 |
| 2012/0184140 | A1 * | 7/2012 | Davis | H01R 12/724 439/607.34 |
| 2019/0020155 | A1 * | 1/2019 | Trout | H01R 13/6587 |

* cited by examiner

*Primary Examiner* — Xuong M Chung Trans

(57) ABSTRACT

An electrical connector includes a contact module having a dielectric frame holding conductors. The conductors extend between a mating end and a terminating end and have a transition portion between the corresponding mating end and the terminating end passing through the dielectric frame. The transition portions of the conductors have opposite first and second sides and opposite first and second edges between the first and second sides. The dielectric frame has opposite first and second sides generally parallel to the first and second sides of the transition portions. The dielectric frame has insertion loss control windows in at least one of the first side and the second side defining air pockets exposing exposed portions of the corresponding transition portions to air. The size and shape of the insertion loss control windows controlling insertion loss along the conductors.

20 Claims, 4 Drawing Sheets

ELECTRICAL CONNECTOR WITH INSERTION LOSS CONTROL WINDOW IN A CONTACT MODULE

BACKGROUND OF THE INVENTION

The subject matter herein relates generally to an electrical connector configured to transmit electrical signals with low insertion loss.

Electrical connectors include terminals or conductors that provide conductive current paths through the connectors for interconnecting cables, circuit boards, or the like. Some known electrical connectors include contact modules that have a plurality of conductors, which may be arranged in pairs, held in a dielectric frame. As electrical connectors are made smaller, the conductors are susceptible to signal degradation, such as from insertion loss A need remains for a high speed electrical connector with low insertion loss conductors.

BRIEF DESCRIPTION OF THE INVENTION

In one or more embodiments, an electrical connector is provided including a contact module having a dielectric frame holding conductors. The conductors extend between a mating end and a terminating end and have a transition portion between the corresponding mating end and the terminating end passing through the dielectric frame. The transition portions of the conductors have opposite first and second sides and opposite first and second edges between the first and second sides. The dielectric frame has opposite first and second sides generally parallel to the first and second sides of the transition portions. The dielectric frame has insertion loss control windows in at least one of the first side and the second side defining air pockets exposing exposed portions of the corresponding transition portions to air. The size and shape of the insertion loss control windows controlling insertion loss along the conductors.

In one or more embodiments, an electrical connector is provided including a contact module having a dielectric frame holding conductors. The conductors extend between a mating end and a terminating end and have a transition portion between the corresponding mating end and the terminating end passing through the dielectric frame. The transition portions of the conductors have opposite first and second sides and opposite first and second edges between the first and second sides. The conductors are arranged in pairs carrying differential signals. The first edges of the conductors in each pair face each other across a gap. The dielectric frame has opposite first and second sides generally parallel to the first and second sides of the transition portions. The dielectric frame has insertion loss control windows in the first side defining air pockets exposing exposed portions of the corresponding transition portions to air. The insertion loss control windows are aligned with corresponding gaps between conductors of the corresponding pair such that the first sides of the conductors of the corresponding pair are exposed to air and the first edges of the conductors of the corresponding pair are exposed to air.

In one or more embodiments, an electrical connector is provided including a contact module having a dielectric frame holding conductors. The conductors extend between a mating end and a terminating end and have a transition portion between the corresponding mating end and the terminating end passing through the dielectric frame. The transition portions of the conductors have opposite first and second sides and opposite first and second edges between the first and second sides. The dielectric frame has opposite first and second sides generally parallel to the first and second sides of the transition portions. The dielectric frame has insertion loss control windows defining air pockets entirely surrounding exposed portions of the corresponding transition portions to expose the exposed portions to air such that the first and second sides and the first and second edges are exposed in the corresponding insertion loss control window.

DETAILED DESCRIPTION OF THE INVENTION

Figure 1:
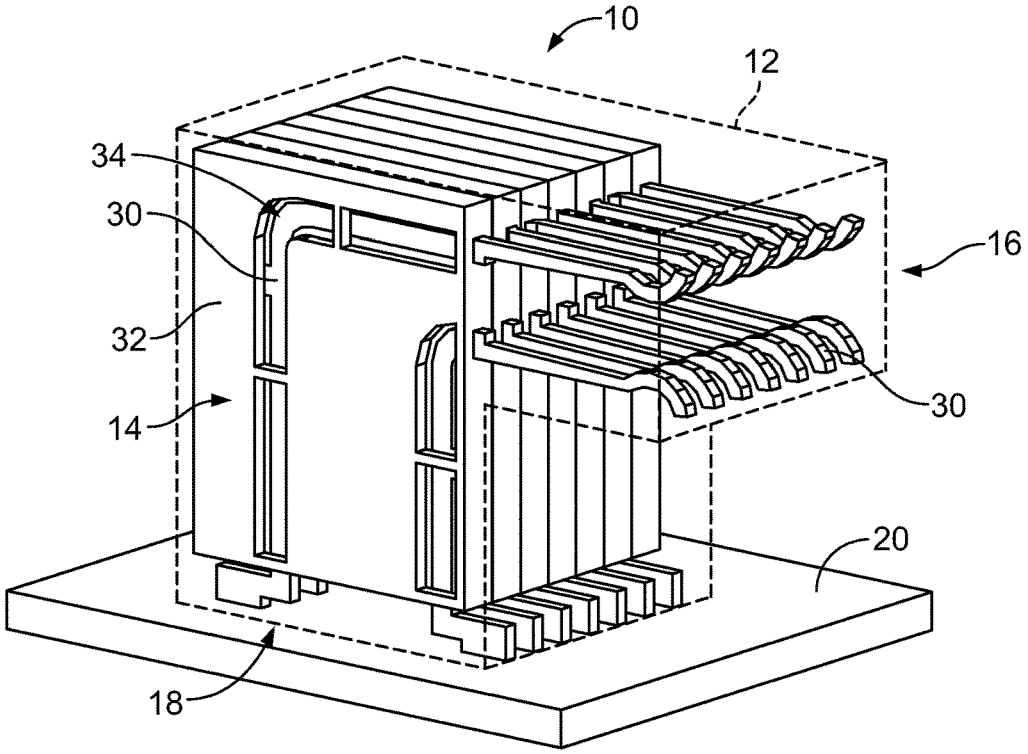
FIG. 1 illustrates an electrical connector in accordance with an exemplary embodiment.

FIG. 1 illustrates an electrical connector 10 in accordance with an exemplary embodiment. The electrical connector 10 includes a housing 12 holding a plurality of contact modules 14 in a stacked configuration. The contact modules 14 are held in the housing 12. The electrical connector 10 extends between a mating end 16 and a terminating end 18. In an exemplary embodiment, the electrical connector 10 is configured to be mounted to a circuit board 20 at the terminating end 18. Alternatively, the electrical connector 10 may be a cable electrical connector having a plurality of cables at the terminating end 18.

In the illustrated embodiment, the electrical connector 10 is a right angle connector having the mating end 16 and the terminating end 18 oriented perpendicular to each other. Other orientations are possible in alternative embodiments. In the illustrated embodiment, the mating end 16 defines a card edge slot configured to receive a card edge of a circuit card; however, other types of electrical connectors 10 may be provided in alternative embodiments.

The contact modules 14 each include a plurality of conductors 30 extending between the mating end 16 and the terminating end 18. The conductors 30 are configured to be electrically connected to the circuit board 20. The conductors 30 are configured to be electrically connected to a mating electrical connector at the mating end 16.

The contact modules 14 each include a dielectric frame 32 holding the conductors 30. In various embodiments, the conductors 30 may be formed from a leadframe and the dielectric frame 32 may be overmolded over the conductors 30 of the leadframe. Other types of contact modules may be provided in alternative embodiments. For example, the dielectric frame 32 may be pre-formed and the conductors 30 may be loaded into the dielectric frame 32 in alternative embodiments.

In an exemplary embodiment, the dielectric frame 32 is designed to improve insertion loss through the contact module 14. For example, in an exemplary embodiment, the dielectric frame 32 includes openings or windows 34 exposing the conductors 30 to air to improve insertion loss of the conductors 30 through the contact module 14. The size, shape, and location of the windows 34 are designed to control insertion loss. The dielectric frame 32 may be designed to improve other aspects of signal integrity through the contact module 14, such as to improve skew control, crosstalk or other characteristics.

Figure 2:
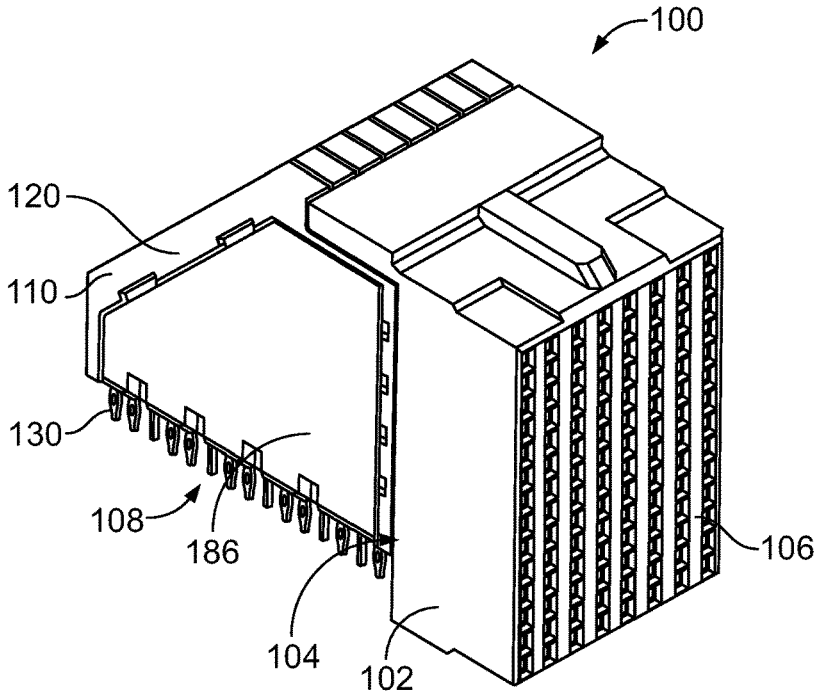
FIG. 2 is a perspective view of an electrical connector formed in accordance with an exemplary embodiment.
Figure 3:
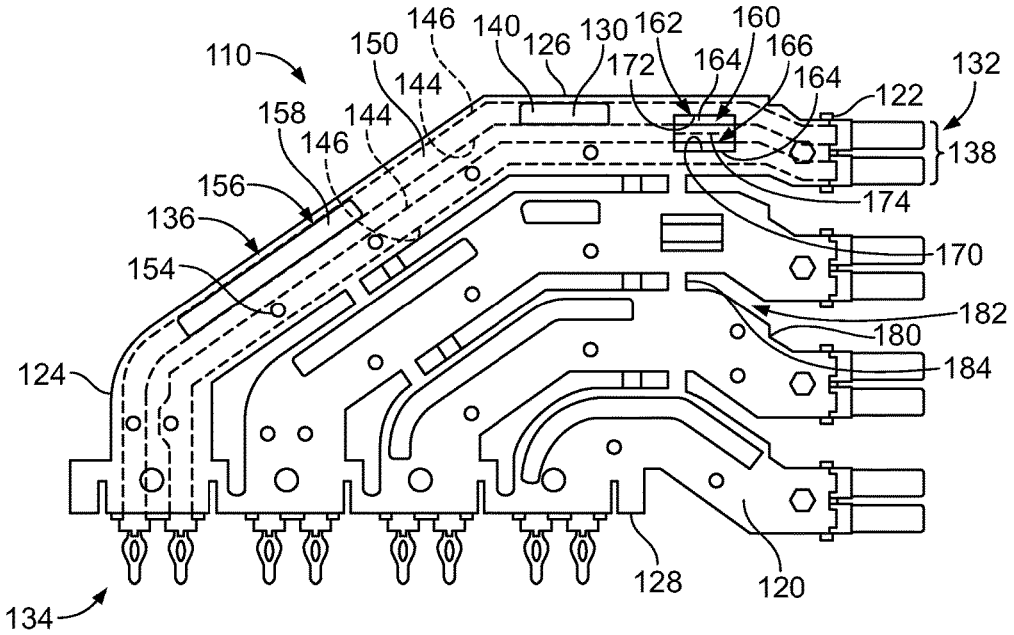
FIG. 3 illustrates a first side of a contact module of the electrical connector in accordance with an exemplary embodiment.
Figure 4:
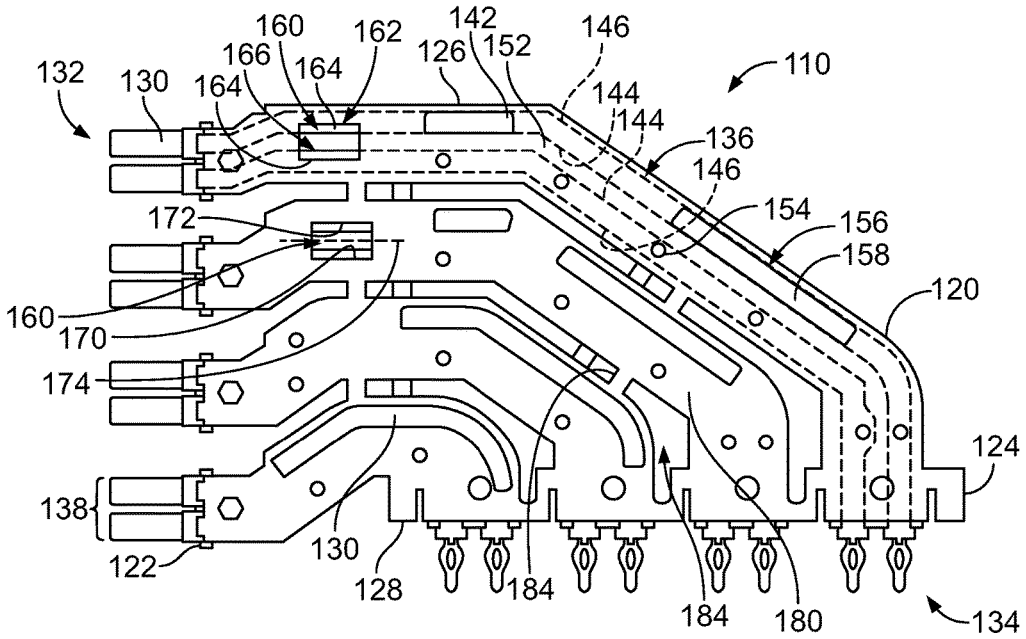
FIG. 4 illustrates a second side of the contact module.
Figure 5:
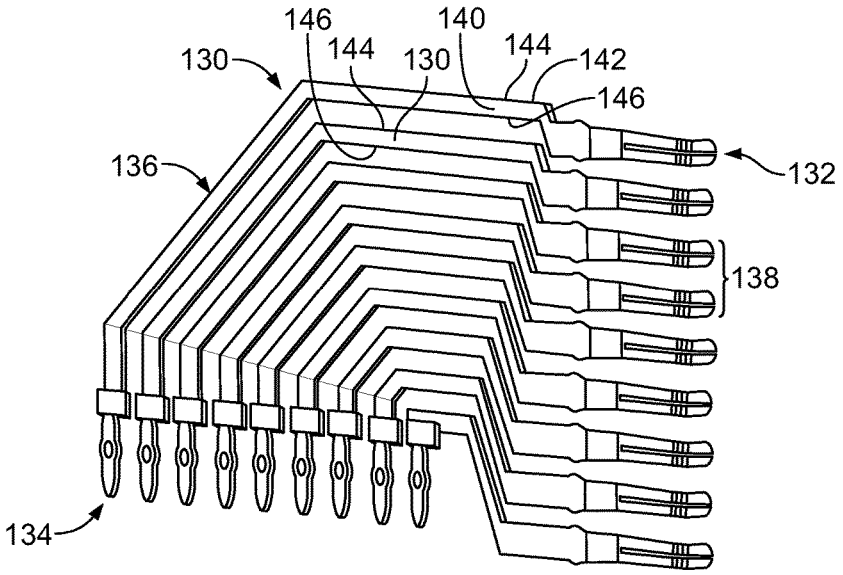
FIG. 5 illustrates a portion of the contact module showing conductors of the contact module in accordance with an exemplary embodiment.

FIG. 2 is a perspective view of an electrical connector 100 formed in accordance with an exemplary embodiment. FIG. 3 illustrates a first side of conductors 130 of a contact module 110 of the electrical connector 100 in accordance with an exemplary embodiment. FIG. 4 illustrates a second side of the conductors 130 of the contact module 110. FIG. 5 illustrates a portion of the contact module 110 showing conductors 130 of the contact module 110 in accordance with an exemplary embodiment.

The electrical connector 100 includes a housing 102 (FIG. 2) holding a plurality of the contact modules 110 in a stacked configuration. In an exemplary embodiment, the housing 102 includes a cavity 104 that receives the contact modules 110. In the illustrated embodiment, the electrical connector 100 is a high-speed backplane receptacle connector, such as a Z-PACK TinMan receptacle connector commercially available from TE Connectivity Corporation, Berwyn, Pa.

The electrical connector 100 extends between a mating end 106 and a terminating end 108. In an exemplary embodiment, the electrical connector 100 is a right-angle connector having the mating end 106 perpendicular to the terminating end 108. Optionally, the electrical connector 100 may be configured to be mounted to a circuit board at the terminating end 108. Alternatively, the electrical connector 100 may be a cable electrical connector having a plurality of cables at the terminating end 108.

The contact modules 110 each include a plurality of conductors 130 extending between the mating end 106 and the terminating end 108. The conductors 130 are configured to be electrically connected to the circuit board (or the cables in the cable electrical connector). The conductors 130 are configured to be electrically connected to a mating electrical connector, such as a header connector, at the mating end 106.

The contact modules 110 each include a dielectric frame 120 (FIGS. 3 and 4) holding the conductors 130. In an exemplary embodiment, the dielectric frame 120 may be overmolded over the conductors 130 of the leadframe. Other types of contact modules may be provided in alternative embodiments. For example, the dielectric frame 120 may be pre-formed and the conductors 130 may be loaded into the dielectric frame 120 in alternative embodiments. In an exemplary embodiment, the dielectric frame 120 includes a front 122, a rear 124, a top 126 and a bottom 128. In the illustrated embodiment, the front 122 is configured to be loaded into the cavity 104 of the housing 102 at the mating end 106. In the illustrated embodiment, the bottom 128 defines the terminating end 108 of the electrical connector 100.

In an exemplary embodiment, the conductors 130 are formed from a leadframe. The conductors 130 are signal contacts extending between the mating end 106 and the terminating end 108 for electrically connecting the electrical connector 100 to the mating connector and the circuit board. Optionally, some of the conductors 130 may be ground contacts arranged between various signal contacts to provide electrical shielding for the signal contacts. Alternatively, as in the illustrated embodiment, all of the conductors 130 are signal contacts; however, the contact modules 110 may include shields for providing electrical shielding.

The conductors 130 each include a mating end 132, a terminating end 134 and a transition portion 136 (FIG. 5) extending between the mating end 132 and the terminating end 134. The transition portion 136 extends through the dielectric frame 120 and may be at least partially embedded in the dielectric frame 120.

In the illustrated embodiment, the mating end 132 extends forward from the front 122 of the dielectric frame 120 for mating connection with the mating connector. Optionally, the mating end 132 may form a socket contact or receptacle configured to be mated with a corresponding mating contact of the mating connector. For example, in the illustrated embodiment, the mating end 132 includes a pair of beams separated by a gap configured to receive a pin contact. Other types of contacts may be provided in alternative embodiments at the mating end 132, such as a pin contact, a spring beam, or another type of contact.

In the illustrated embodiment, the terminating end 134 extends downward from the bottom 128 for termination to the circuit board. Optionally, the terminating end 134 may be a compliant pin, such as an eye of the needle pin, configured to be loaded into a plated via of the circuit board. Other types of terminating contacts may be provided at the terminating end 134, such as solder contacts, spring beams, and the like.

In an exemplary embodiment, the conductors 130 are stamped and formed contacts stamped from a metal plate. Optionally, each of the conductors 130 may be stamped from the same plate is part of a leadframe. In an exemplary embodiment, the conductors 130 are arranged in pairs 138 configured to convey differential signals. However, in alternative embodiments, the conductors 130 may be single ended conductors rather than differential pairs.

The transition portions 136 transition between the mating ends 132 and the terminating ends 134. Optionally, the transition portions 136 may have a right angle transition between the mating ends 132 and the terminating ends 134 to define a right angle contact module 110. In an exemplary embodiment, each conductor 130 has a first side 140, a second side 142, an inner or first edge 144 and an outer or second edge 146. Optionally, the first and second edges 144, 146 may be the cut edges formed during the stamping process. For example, the first and second edges 144, 146 extend through the thickness of the metal plate used in the stamping process. Optionally, the first and second sides 140, 142 are wider than the first and second edges 144, 146.

The dielectric frame 120 holds the conductors 130. In an exemplary embodiment, the dielectric frame 120 is overmolded over the conductors 130. The dielectric frame 120 has opposite first and second sides 150, 152 extending between the front 122 and the rear 124 and extending between the top 126 and the bottom 128. The sides 150, 152 face other contact modules 110 in the contact module stack. In an exemplary embodiment, the first and second sides 150, 152 are generally parallel to the first and second sides 140, 142 of the conductors 130.

In an exemplary embodiment, the dielectric frame 120 includes a number of openings in the first side 150 (FIG. 3) and/or the second side 152 (FIG. 4) exposing the conductors 130. For example, in an exemplary embodiment, the dielectric frame 120 includes a plurality of pinch points 154 in the first and second sides 150, 152 that are formed during the manufacturing process. For example, the pinch points 154 are formed by components in the mold that are used to hold the conductors 130 during the molding process. When the mold is removed, the pinch points 154 remain in the dielectric frame 120. The pinch points 154 are small openings placed intermittently along the lengths of the conductors 130 used for manufacturing the contact module 110 for holding the conductors 130 during molding. Longer conductors 130 have more pinch points 154. In the illustrated embodiment, the pinch points 154 are circular; however, the pinch points 154 may have other shapes in alternative embodiments.

In the illustrated embodiment, the dielectric frame 120 includes a plurality of skew windows 156 in the first side 150 and/or the second side 152. The skew windows 156 expose sections of the transition portion 136 to air. The skew windows 156 define exposed portions 158 of the transition portions 136. The skew windows 156 are used to control skew along the conductors 130. The skew windows 156 enhance signal integrity and electrical performance of the conductors 130. In the illustrated embodiment, the skew windows 156 are only provided along the longer of the two conductors 130 within each pair 138. By exposing the longer conductors to air, the signals passing through the longer conductors may travel more quickly to reduce skew along the pair 138 of conductors 130 between the mating end 132 and the terminating end 134.

In an exemplary embodiment, the dielectric frame 120 includes insertion loss control windows 160 in the first side 150 and/or the second side 152. The insertion loss control windows 160 control insertion loss along the conductors 130. The insertion loss control windows 160 define air pockets 162 exposing exposed portions 164 of the transition portions 136 to air. Providing air around the exposed portions 164 of the transition portions 136 reduces insertion loss and enhances signal integrity of the conductors 130. The size and shape of the insertion loss control windows 160 control insertion losses along the conductors 130.

In an exemplary embodiment, the insertion loss control windows 160 bridge across the exposed portions 164 of the corresponding pairs 138 of conductors 130. For example, the insertion loss control windows 160 are aligned with gaps 166 between conductors 130 of the corresponding pair 138 of conductors 130. Each insertion loss control window 160 exposes two conductors 130. For example, the first edges 144 of each conductor 130 within the pair 138 of conductors 130 face each other across the gap 166. As such, the first edge 144 of the outer conductor 130 of the pair 138 is along the bottom edge and the first edge 144 of the inner conductor 130 of the pair 138 is along the top edge. The insertion loss control window 160 exposes both first edges 144 of the pair 138 in the same insertion loss control window 160. In an exemplary embodiment, the insertion loss control window 160 may be approximately centered above the corresponding gap 166. In an exemplary embodiment, the insertion loss control window 160 is provided on both the first side 150 and the second side 152.

Optionally, portions of the first sides 140 and/or the second sides 142 of both conductors 130 within the pair 138 are exposed within the insertion loss control window 160. Optionally, approximately half of the width of both conductors 130 within the pair 138 are exposed within the insertion loss control window 160. In such embodiments, the outer halves of both conductors 130 within the pair 138 are covered by the material of the dielectric frame 120. Alternatively, less than half of the width of each conductor 130 may be exposed within the insertion loss control window 160. In other alternative embodiments, more than half of the width of each conductor 130 is exposed within the insertion loss control window 160. In various embodiments, the entire width of the conductors 130 of each pair 138 are exposed within the insertion loss control window 160. For example, the insertion loss control window 160 may extend to both second edges 146 (for example the outer edges) of both conductors 130 of the pair 138.

In an exemplary embodiment, the insertion loss control window 160 extends between an inner edge 170 and an outer edge 172. The insertion loss control window 160 includes a center line 174 centered between the inner edge 170 and the outer edge 172. Optionally, the center line 174 may be aligned with the corresponding gap 166 between the first edges 144 of the pair 138 of conductors 130. Optionally, the inner edge 170 may be aligned with the exposed portion 164 of the inner of the two conductors within the pair 138 and the outer edge 172 may be aligned with the exposed portion 164 of the outer of the two conductors 130 of the pair 138.

In an exemplary embodiment, the dielectric frame 120 includes a plurality of frame members 180 extending between the mating end 106 and the terminating end 108, such as between the front 122 and the bottom 128. The frame members 180 hold the conductors 130. The frame members 180 are separated by slots 182. In an exemplary embodiment, the slots 182 are non-continuous and separated by tie bars 184 between the frame members 180. The tie bars 184 are formed during the molding process when the dielectric material is injected into the mold to form the frame members 180. The tie bars 184 hold the relative positions of the frame members 180.

In an exemplary embodiment, each frame member holds a corresponding pair 138 of the conductors 130. The slots 182 provide a space for a shield 186 (FIG. 2). For example, the shield 186 may be coupled to the dielectric frame 120 and extend into the slots 182 to provide electrical shielding between the pairs 138 of conductors 130. The shield 186 may extend along the first side 150 and/or the second side 152. Optionally, two shields 186 may be coupled to the dielectric frame 120 on each of the first and second sides 150, 152 to provide electrical shielding on both sides 150, 152.

In an exemplary embodiment, the insertion loss control windows 160 are provided in the frame members 180, such as approximately centered between corresponding slots 182. Optionally, each frame member 180 may include at least one insertion loss control window 160; however, some of the frame members 180, such as frame members 180 associated with shorter conductors 130, do not include insertion loss control windows 160, such as when there is insufficient space along the frame members 180 to fit the insertion loss control windows 160. Optionally, at least some of the frame members 180 may include multiple insertion loss control windows 160. Optionally, the insertion loss control windows 160 may be separate from the skew windows 156. Alternatively, the insertion loss control windows 160 may be combined with the skew windows 156. For example, the skew window 156 may extend from the insertion loss control window 160 to expose more of the outer of the two conductors 130 of the pair 138, such as a greater width of the outer conductor and/or a greater length of the outer conductor as compared to the inner conductor of the corresponding pair 138.

Figure 6:
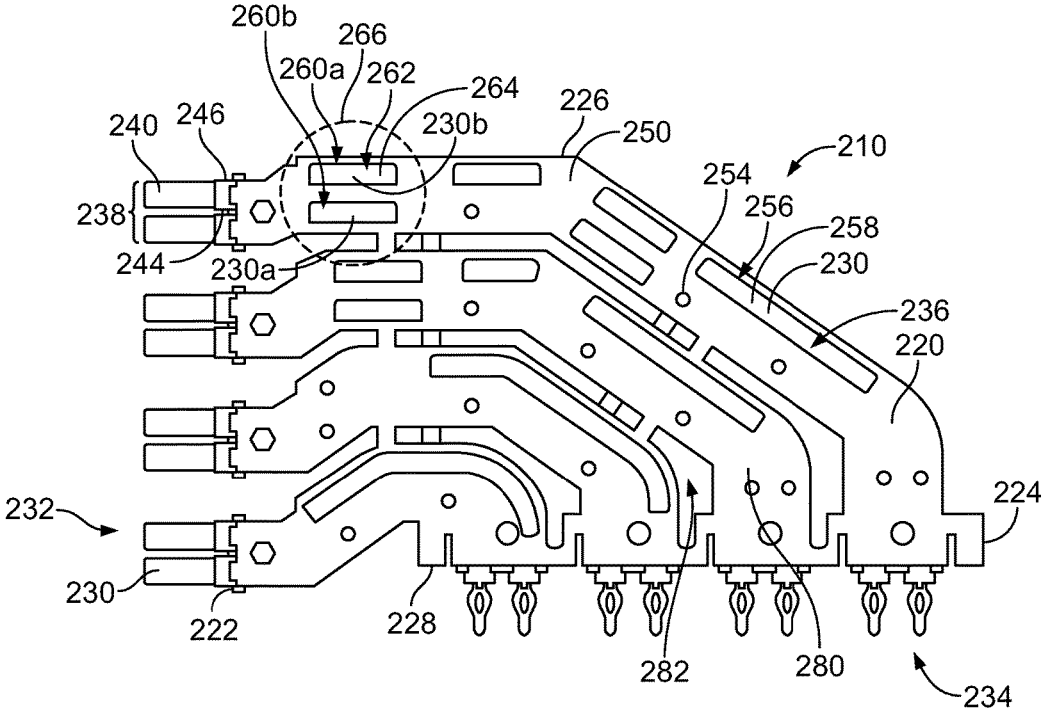
FIG. 6 illustrates a contact module for the electrical connector in accordance with an exemplary embodiment.

FIG. 6 illustrates a contact module 210 for the electrical connector 100 in accordance with an exemplary embodiment. The contact module 210 may be used in place of the contact module 110 (shown in FIG. 3). The contact module 210 includes a plurality of conductors 230 and a dielectric frame 220 holding the conductors 230. In an exemplary embodiment, the conductors 230 are part of a leadframe and the dielectric frame 220 is overmolded over the conductors 230. In an exemplary embodiment, the dielectric frame 220 includes a front 222, a rear 224, a top 226 and a bottom 228.

The conductors 230 each include a mating end 232, a terminating end 234 and a transition portion 236 extending through the dielectric frame 220. In an exemplary embodiment, the conductors 230 are arranged in pairs 238 configured to convey differential signals. In an exemplary embodiment, each conductor 230 has an opposite first side 240 and second side (not shown) extending between first and second edges 244, 246.

The dielectric frame 220 has an opposite first side 250 and second side (not shown). In an exemplary embodiment, the dielectric frame 220 includes a plurality of frame members 280 extending between the mating end 106 and the terminating end 108, such as between the front 222 and the bottom 228. The frame members 280 hold the conductors 230. The frame members 280 are separated by slots 282.

In an exemplary embodiment, the dielectric frame 220 includes a number of openings in the frame members 280 exposing the conductors 230. For example, in an exemplary embodiment, the dielectric frame 220 includes a plurality of pinch points 254, a plurality of skew windows 256 defining exposed portions 258 and insertion loss control windows 260. The insertion loss control windows 260 control insertion loss along the conductors 230. The insertion loss control windows 260 define air pockets 262 exposing exposed portions 264 of the transition portions 236 to air. Providing air around the exposed portions 264 of the transition portions 236 reduces insertion loss and enhances signal integrity of the conductors 230. The size and shape of the insertion loss control windows 260 control insertion losses along the conductors 230.

In an exemplary embodiment, the insertion loss control windows 260 are arranged in pairs 266 along corresponding pairs 238 of the conductors 230. For example, outer insertion loss control windows 260*a* extend along the outer conductor 230*a* of the pair 238 and inner insertion loss control windows 260*b* extend along the inner conductor 230*b* of the pair 238. In an exemplary embodiment, the insertion loss control windows 260*a*, 260*b* in the corresponding pair of windows have identical sizes and shapes to expose both exposed portions 264 to the same amount of air. In an exemplary embodiment, the insertion loss control windows 260*a*, 260*b* in the corresponding pair of windows are aligned along the lengths of the conductors 230. In various embodiments, at least some of the frame members 280 only include insertion loss control windows 260*a*, 260*b* and do not include other windows or pinch points between them on such frame member 280. In an exemplary embodiment, the skew windows 256 are different than the insertion loss control windows 260*a*, 260*b* as the skew windows 256 define air pockets exposing the exposed portions 258 of only the longer or outer conductors 230*a* of the corresponding pair 238 to air for skew control along the conductors 230. In contrast, the insertion loss control windows 260*a*, 260*b* are provided in pairs where both conductors 230*a*, 230*b* are exposed to air by the insertion loss control windows 260*a*, 260*b*.

Figure 7:
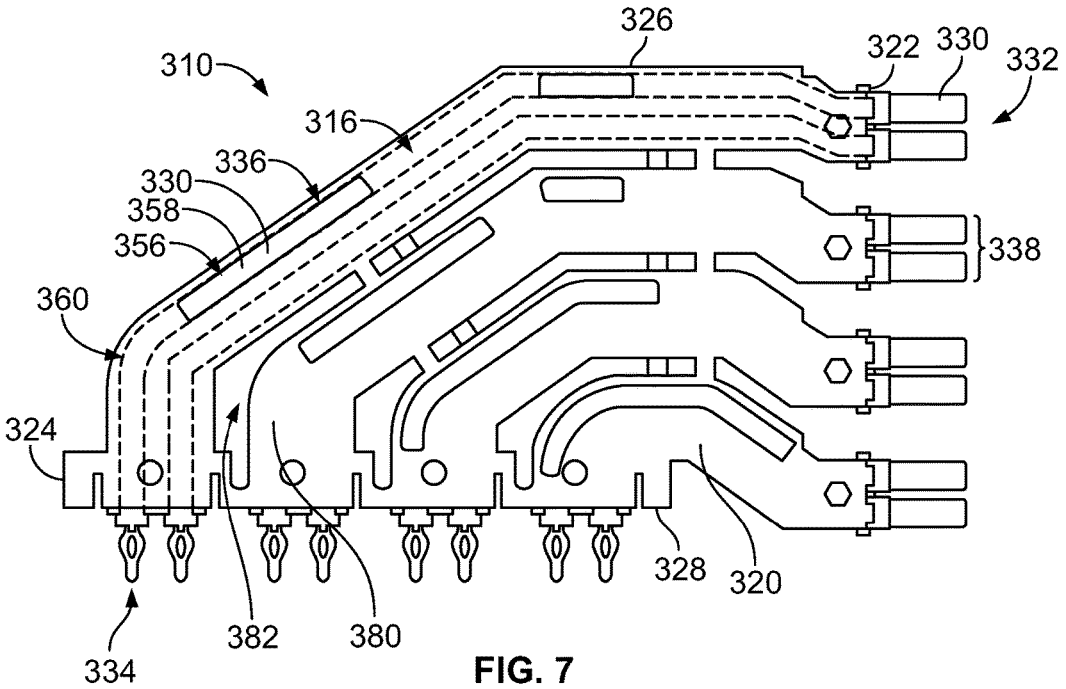
FIG. 7 is a side view of a contact module for the electrical connector in accordance with an exemplary embodiment.
Figure 8:
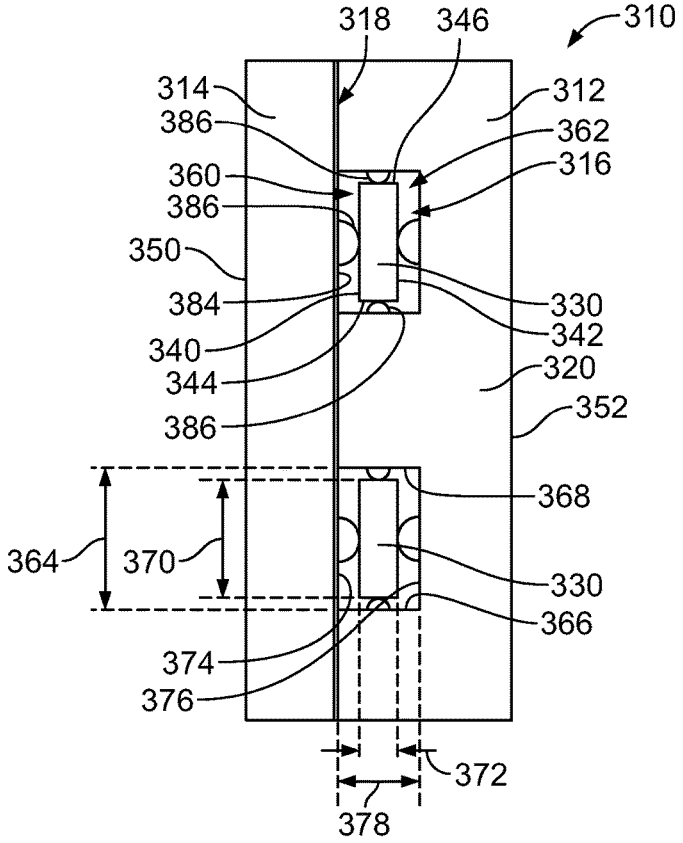
FIG. 8 is a cross-sectional view of a portion of the contact module in accordance with an exemplary embodiment.

FIG. 7 is a side view of a contact module 310 for the electrical connector 100 in accordance with an exemplary embodiment. FIG. 8 is a cross-sectional view of a portion of the contact module 310 in accordance with an exemplary embodiment. The contact module 310 may be used in place of the contact module 110 (shown in FIG. 2). The contact module 310 includes a plurality of conductors 330 (shown in phantom in FIG. 7) and a dielectric frame 320 holding the conductors 330. In an exemplary embodiment, the conductors 330 are stamped and formed conductors. The dielectric frame 320 is a molded frame holding the conductors 330.

In an exemplary embodiment, the dielectric frame 320 is pre-molded and the conductors 330 are inserted or loaded into the dielectric frame 320. Optionally, the dielectric frame 320 is a multi-piece frame having a first frame 312 and a second frame 314 coupled to the first frame 312 after the conductors 330 are loaded into the first frame 312. The first frame 312 includes pockets 316 receiving the conductors 330. Optionally, the second frame 312 may form pockets or portions of the pockets. The first and second frame 312, 314 meet at a seam 318.

In an exemplary embodiment, the dielectric frame 320 includes a front 322, a rear 324, a top 326 and a bottom 328. The dielectric frame 320 has opposite first and second sides 350, 352. In an exemplary embodiment, the dielectric frame 320 includes a plurality of frame members 380 extending between the mating end 106 and the terminating end 108, such as between the front 322 and the bottom 328. The frame members 380 hold the conductors 330. The frame members 380 are separated by slots 382.

The conductors 330 each include a mating end 332, a terminating end 334 and a transition portion 336 extending through the dielectric frame 320. The transition portions 336 are received in the pockets 316. In an exemplary embodiment, the conductors 330 are arranged in pairs 338 configured to convey differential signals. In an exemplary embodiment, each conductor 330 has first and second sides 340, 342 extending between first and second edges 344, 346.

In an exemplary embodiment, the dielectric frame 320 includes a number of openings in the frame members 380 exposing the conductors 330. For example, in an exemplary embodiment, the dielectric frame 320 includes a plurality of skew windows 356 defining exposed portions 358. The skew windows 356 are open at the first and second sides 350, 352. The skew windows 356 are open to the pockets 316.

The dielectric frame 320 includes insertion loss control windows 360. In an exemplary embodiment, the insertion loss control windows 360 are defined by the pockets 316. The insertion loss control windows 360 control insertion loss along the conductors 330. The insertion loss control windows 360 define air pockets 362 exposing exposed portions of the transition portions 336 to air. Providing air around the transition portions 336 reduces insertion loss and enhances signal integrity of the conductors 330. The size and shape of the insertion loss control windows 360 control insertion losses along the conductors 330. In an exemplary embodiment, the insertion loss control windows 360 are internal to the dielectric frame 320 such that the air pockets 362 are enclosed by the dielectric frame 320. However, portions of the insertion loss control windows 360 may be open to the exterior environment. For example, portions of the insertion loss control windows 360 may extend to the first side 350 or the second side 352.

The insertion loss control window 360 entirely surrounds the corresponding exposed portion of the transition portion 336. The insertion loss control window 360 exposes to air the first and second sides 340, 342 and the first and second edges 344, 346 of the corresponding conductor 330 in the same air pocket 362. The pocket 316 is oversized relative to the conductor 330 to form the air pocket 362 around the conductor 330. For example, a height 364 of the pocket 362 between an inner edge wall 366 and an outer edge wall 368 is greater than a height 370 of the conductor 330 between the edges 344, 346 and a width 372 of the pocket 362 between a first side wall 374 and a second side wall 376 is greater than a width 378 of the conductor 330 between the sides 340, 342. The inner edge wall 366 is spaced apart from the first edge 344 of the corresponding conductor 330 and the outer edge wall 368 is spaced apart from the second edge 346 of the corresponding conductor 330. The first side wall 374 is spaced apart from the first side 340 of the corresponding conductor 330 and the second side wall 376 is spaced apart from the second side 342 of the corresponding conductor 330. The inner edge wall 366, the outer edge wall 368, the first side wall 374 and the second side wall 376 define pocket walls 384 defining the pocket 316. The pocket 316 may include other walls to form a pocket having another shape in alternative embodiments.

In an exemplary embodiment, the dielectric frame 320 includes locating tabs 386 extending into the air pockets 362 to engage the conductors 330 and locate the conductors 330 in the insertion loss control windows 360. The locating tabs 386 extend from the inner edge wall 366, the outer edge wall 368, the first side wall 374 and the second side wall 376 to engage the conductor 330. The locating tabs 386 engage the first edge 344, the second edge 346, the first side 340 and the second side 342. The locating tabs 386 hold the inner edge wall 366 apart from the first edge 344 and the outer edge wall 368 apart from the second edge 346. The locating tabs 386 hold the first side wall 374 apart from the first side 340 and the second side wall 376 apart from the second side 342.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a contact module having a dielectric frame holding conductors;

the conductors extend between a mating end and a terminating end, the conductors have a transition portion between the corresponding mating end and the terminating end passing through the dielectric frame, the transition portions of the conductors have opposite first and second sides and opposite first and second edges between the first and second sides;

the dielectric frame having opposite first and second sides generally parallel to the first and second sides of the transition portions, the dielectric frame having insertion loss control windows in at least one of the first side and the second side defining air pockets exposing exposed portions of the corresponding transition portions to air, the size and shape of the insertion loss control windows controlling insertion loss along the conductors.

2. The electrical connector of claim 1, wherein the insertion loss control window exposes at least two adjacent conductors in the same air pocket.

3. The electrical connector of claim 2, wherein the insertion loss control window bridges across the exposed portions of the at least two adjacent conductors.

4. The electrical connector of claim 1, wherein the insertion loss control window entirely surrounds the corresponding exposed portion such that the first and second sides and the first and second edges of the corresponding conductor are exposed in the same air pocket.

5. The electrical connector of claim 1, wherein the conductors are arranged in pairs carrying differential signals, the insertion loss control windows being arranged in pairs along corresponding pairs of the conductors.

6. The electrical connector of claim 5, wherein the insertion loss control windows in the corresponding pair of insertion loss control windows have identical sizes and shapes.

7. The electrical connector of claim 5, further comprising skew windows in at least one of the first side and the second side of the dielectric frame defining air pockets exposing exposed portions of corresponding transition portions to air, the skew windows exposing only longer conductors of the corresponding pair of conductors for skew control along the conductors.

8. The electrical connector of claim 1, further comprising a shield coupled to the first side to provide electrical shielding for the conductors, the shield covering the insertion loss control window.

9. An electrical connector comprising:

a contact module having a dielectric frame holding conductors;

the conductors extend between a mating end and a terminating end, the conductors have a transition portion between the corresponding mating end and the terminating end passing through the dielectric frame, the transition portions of the conductors have opposite first and second sides and opposite first and second edges between the first and second sides, the conductors being arranged in pairs carrying differential signals, the first edges of the conductors in each pair facing each other across a gap;

the dielectric frame having opposite first and second sides generally parallel to the first and second sides of the transition portions, the dielectric frame having insertion loss control windows in the first side defining air pockets exposing exposed portions of the corresponding transition portions to air, the insertion loss control windows being aligned with corresponding gaps between conductors of the corresponding pair such that the first sides of the conductors of the corresponding pair are exposed to air and the first edges of the conductors of the corresponding pair are exposed to air.

10. The electrical connector of claim 9, wherein the insertion loss control window bridges across the exposed portions of the corresponding conductors.

11. The electrical connector of claim 9, wherein the insertion loss control window extends between an inner edge and an outer edge, the insertion loss control window having a center line between the inner edge and the outer edge, the centerline being aligned with the corresponding gap between the first edges of the corresponding conductors.

12. The electrical connector of claim 11, wherein the inner edge is aligned with the exposed portions of one of the conductors of the corresponding pair and the outer edge is aligned with the exposed portion of the other of the conductors of the pair.

13. The electrical connector of claim 9, wherein the insertion loss control window extends between the first side and the second side of the dielectric frame.

14. The electrical connector of claim 9, wherein the dielectric frame includes frame members extending between a mating end and a terminating end of the dielectric frame, the frame member being separated by slots, the slots being non-continuous and separated by tie bars between the frame members, each frame member housing a corresponding pair of the conductors, the insertion loss control windows be approximately centered along the corresponding frame members.

15. The electrical connector of claim 9, wherein the insertion loss control window exposes the second edges of both conductors of the corresponding pair.

16. An electrical connector comprising:

a contact module having a dielectric frame holding conductors;

the conductors extend between a mating end and a terminating end, the conductors have a transition portion between the corresponding mating end and the terminating end passing through the dielectric frame, the transition portions of the conductors have opposite first and second sides and opposite first and second edges between the first and second sides;

the dielectric frame having opposite first and second sides generally parallel to the first and second sides of the transition portions, the dielectric frame having insertion loss control windows defining air pockets entirely surrounding exposed portions of the corresponding transition portions to expose the exposed portions to air such that the first and second sides and the first and second edges are exposed in the corresponding insertion loss control window.

17. The electrical connector of claim 16, wherein the dielectric frame includes locating tabs extending into the air pockets to engage the conductors and locate the conductors in the insertion loss control windows.

18. The electrical connector of claim 16, wherein the insertion loss control window includes an inner edge wall spaced apart from the first edge of the corresponding conductor and an outer edge wall is spaced apart from the second edge of the corresponding conductor.

19. The electrical connector of claim 16, wherein the dielectric frame includes a first frame and a second frame, the first frame including pockets defined by pocket walls oversized relative to the conductors, the conductors being received in the pockets and spaced apart from the pocket walls, the second frame covering the pockets.

20. The electrical connector of claim 16, wherein the insertion loss control windows are internal to the dielectric frame such that the air pockets or enclosed by the dielectric frame.

* * * * *